US005622013A

United States Patent [19]

Ban et al.

[11] Patent Number: 5,622,013

[45] Date of Patent: Apr. 22, 1997

[54] STRUCTURE OF MULTIPURPOSE SUSPENDED ROOF ARENA CAPABLE OF CHANGING SPACE VOLUME AND CONSTRUCTION METHOD THEREOF

[75] Inventors: Shigeru Ban; Masaru Ozaki; Arata Yoshida; Masahiro Hanyu; Takeshi Miyazaki; Seiichi Muramatsu; Haruji Tsubota; Naoya Sasaki, all of Tokyo, Japan

[73] Assignee: Kajima Corporation, Tokyo, Japan

[21] Appl. No.: 409,854

[22] Filed: Mar. 23, 1995

[30] Foreign Application Priority Data

| | | | |
|---|---|---|---|
| Mar. 7, 1994 | [JP] | Japan | 7-046936 |
| Mar. 24, 1994 | [JP] | Japan | 6-053504 |
| Dec. 20, 1994 | [JP] | Japan | 6-316383 |

[51] Int. Cl.[6] ..... E04B 7/14

[52] U.S. Cl. ..... 52/83; 52/9; 52/64; 52/745.08

[58] Field of Search ..... 52/64, 66, 9, 83, 52/745.06, 745.08; 135/906, 907, 908, 120.4, 119, 115, 124, 97, 117

[56] References Cited

U.S. PATENT DOCUMENTS

| | | | |
|---|---|---|---|
| 1,433,547 | 10/1922 | Hadden | 52/9 |
| 3,002,234 | 10/1961 | Waterbury | 52/9 |
| 3,510,996 | 5/1970 | Popil | 52/64 |
| 3,922,822 | 12/1975 | Mollinger | 52/83 |
| 3,975,869 | 8/1976 | Bouton | 52/9 |
| 4,052,834 | 10/1977 | Ellen | 52/745.06 |
| 4,074,502 | 2/1978 | Peter | 52/83 X |
| 4,367,612 | 1/1983 | Sutter | 52/9 |
| 4,565,036 | 1/1986 | Lyman, Jr. | 52/9 |
| 4,651,496 | 3/1987 | Schildge, Jr. | 52/745.06 |
| 4,688,357 | 8/1987 | Deaton | 52/9 |
| 4,920,707 | 5/1990 | Moskaliuk et al. | 52/83 X |
| 5,010,695 | 4/1991 | Schildge, Jr. | 52/83 X |
| 5,103,600 | 4/1992 | Geiger et al. | 52/66 X |

FOREIGN PATENT DOCUMENTS

| | | | |
|---|---|---|---|
| 598633 | 6/1933 | Germany . | |
| 1459961 | 1/1969 | Germany . | |
| 2006240 | 8/1971 | Germany . | |
| 2416256 | 10/1975 | Germany | 52/9 |
| 4318710 | 12/1994 | Germany . | |
| 70868 | 3/1990 | Japan | 52/9 |
| 7411191 | 2/1976 | Netherlands | 52/9 |
| 7902899 | 10/1980 | Netherlands | 52/9 |
| 744084 | 6/1980 | U.S.S.R. | 52/86 |

OTHER PUBLICATIONS

Betonwerk+Fertigteil Technik, vol. 58, No. 9, Sep., 1992 pp. 122–124.

Deutsche Bauzeitschrift—DBZ, vol. 12, Nov., 1964, pp. 1817–1832.

*Primary Examiner*—Carl D. Friedman
*Assistant Examiner*—Aimee E. McTigue
*Attorney, Agent, or Firm*—James H. Tilberry

[57] ABSTRACT

A multipurpose arena with a suspended roof and an interior which can be adjusted to accommodate events requiring different space arrangements. The roof is made of sections suspended between opposed supporting pylons and assumes a catenary shape. Rail-mounted, motor-driven, stands can be shifted from place to place depending on the event or events being catered. Partitions divide the arena into separate private compartments wherein separate events can be held simultaneously in each compartment.

16 Claims, 20 Drawing Sheets

STRUCTURE OF MULTIPURPOSE SUSPENDED ROOF ARENA CAPABLE OF CHANGING SPACE VOLUME AND CONSTRUCTION METHOD THEREOF

BACKGROUND OF THE INVENTION

1. Field of the Invention

The field of invention relates to multipurpose arenas having suspended roofs and means for adjusting spectator seating and space volume best suited for particular events.

2. Description of the Prior Art

To use an existing arena for various purposes, a variable driving unit such as a movable stand has been used. However, the unit has not harmonized with a construction plan, and the value added by the synergistic effect to be obtained by harmonizing the adjustable stands with the overall construction plan has not been considered. Moreover, existing arenas have convex-shaped roofs with unnecessary load space because of the use of air film structures, parasol-dome tension film structures, or hybrid film structures. Furthermore, existing suspended roofs cannot be suspended only by a suspending member. Thus, the shapes of suspended roofs have been limited to saddle-type configurations.

Various functions provided in existing arenas, such as sound, illumination, and air conditioning, have depended on heavy equipment including movable stages in order to correspond to various types of events. To improve arena profitability, it is necessary not only to cut the cost of various functions but also to continue to find new attractions. Therefore, it is necessary to improve the serviceability of the arena by having an efficient, practical, and comfortable seating arrangement readily adaptable to various scales of events, with quick set up and dismantling times.

There are generally two prior art methods for the construction of prior art suspended roofs:

(a) The method of roughly constructing a roof at ground level before lifting the same by a crane; and (b) The method of constructing a roof on an integrated scaffold assembled under the roof.

Method (a) is difficult in inclement weather, particularly in high winds, because a suspended roof has only minimal rigidity. Method (b) requires temporary scaffold construction and is time consuming and costly. The present invention solves the above problems with a novel multipurpose arena constructed by methods that save construction time and costs while improving on-the-job safety.

SUMMARY OF THE INVENTION

The present invention provides an arena which includes movable stands that harmonize with an architectural plan so that the amount of equipment for various functions of the arena is minimized, the initial cost and operating costs are decreased, and the profitability of operation is improved. The inventive arena provides comfortable seating, good acoustics, illumination, and air conditioning by the use of a novel suspended roof to decrease the load space of the arena.

The inventive arena is substantially rectangular and supports a rectangular catenary suspended roof designed to functionally vary the interior volume of the arena. A pair of opposed arcuate-shaped stands are provided at opposite ends of the arena which are movable toward and away from each other. Stands are also provided adjacent the long sides of the arena with diminishing tiers of seats as the stands approach the opposite ends of the arena. The diminishing tiers of seats are designed to be coordinated with a ceiling which decreases in height as it approaches the opposite ends of the arena, resulting in an economy of space between the diminishing tiered seats and the immediately overhead converging ceiling portion.

The suspended roof of the arena comprises a plurality of opposed structural columns arrayed along opposite longitudinal sides of the arena. A roof section is suspended between each opposed pair of structural columns which, when combined with roof sections suspended between the other opposed pairs of structural columns, constitutes the roof.

The structural columns are secured to concrete foundations which absorb the vertical load of the structural columns and the tension transferred from the roof through the structural columns to the foundations. Roof suspending members comprise wood laminated steel plates which extend between opposed structural members. The steel plates transmit tension from the roof to the concrete foundation through the structural columns. The wooden laminations resist the bending moments imparted to the roof suspending members by the weight of the roof sections suspended on the suspending members.

The method of suspended roof construction of the subject invention consists of constructing suspending members at ground level and positioning them in alignment between respective opposed structural pylons. A pair of opposed temporary columns are mounted on track means for movement between the pylons and the ground level suspending members. Vertical lift means attached to the temporary columns, with means attachable to the opposite ends of a suspending member, lift a suspending member to the top edges of the adjacent pair of opposed structural pylons where they are secured. The temporary columns are then moved to the next adjacent suspending member and the process is repeated until all suspending members are secured in place to their respective opposed structural pylons.

The present invention makes it possible to improve the cost performance of illumination, sound, and air conditioning by changing the volume of the arena. For example, when the arena is fully occupied, it can be set up as shown in FIG. 4. For smaller high-ceiling events, the movable opposed arcuate stands may be shifted to the center of the arena, as shown in FIG. 5. On the other hand, a low-ceiling, small scale, event may be accommodated by moving the movable stands to one side of the arena as shown in FIG. 6. Furthermore, one or two small-space, very low-ceiling, small scale events may be catered by erecting partitions immediately in front of the arcuate stands at the opposite ends of the arena, as shown in FIG. 7. It is also possible to further improve the quality of, and expand the range for, multipurpose events by operating the movable stands in combination with a previously prepared movable floor system, a partition system, and a traveling burton system, including a suspending object system and sound and illumination equipment, the positions of which may be varied in accordance with the scale of the event and the position of the stage.

As shown in FIG. 2(*a*), the vertical space between the roof suspending members permits uniform indirect natural light to illuminate the ceiling of the arena. Furthermore, as shown in FIG. 2(*b*), maintenance is simplified by natural ventilation obtained through the spaces between adjacent roof suspending members, which also saves air conditioning costs by effectively utilizing ambient natural energy. It is also possible to use the spaced terraced roof portions for installing, operating, and maintaining equipment necessary for operating the arena, including light, sound, and exhibiting equipment, and the like.

As shown in FIG. 3, the overhead space volume is reduced by the convex underside of the roof, thereby reducing the cost of heating this space, and, at the same time, improving acoustic clarity without forming a sound focus.

As shown in FIG. 17, the suspending member comprises a steel plate enclosed in laminated wood which provides flexural rigidity due to the tension borne by the steel plate and the bending moment borne by the laminated wood. The suspending member independently has a shape-keeping ability. The laminated wood bears a local bending moment due to snow load and wind force, and protects the steel plate from rusting. The novel combination of wood laminated steel plates reduces the total weight of the roof. The catenary suspending member keeps its shape with no tension, and directly forms the shape of the roof, as shown in FIG. 15. The gabled cross section shape of the roof is a function of the terraced suspending members, as shown in FIG. 2(*a*).

Because the suspending member units can be lifted and set in place without being influenced by wind, it is possible to shorten the construction period and to decrease construction costs. Moreover, construction can efficiently progress because the novel temporary column and lift system used for lifting and securing the suspending members can be moved in the direction in which the suspending members are sequentially prearranged to be installed.

OBJECTS OF THE INVENTION

It is among the objects of the invention to provide a novel multipurpose suspended roof arena including novel means for constructing the suspended roof; a novel suspended roof configuration; novel means for suspending the roof; and novel means for compartmentalizing the interior of the arena to accommodate events having different spatial needs and requiring different seating arrangements and capacities. It is also among the objects of the invention to provide novel means for admitting natural light into the arena; novel means for ventilating the arena; and novel means for installing, using, and maintaining light, air conditioning, and sound equipment required to cater different events.

BRIEF DESCRIPTION OF THE DRAWINGS

The foregoing and other objects and features of the invention will become apparent from the following description of preferred embodiments of the invention with reference to the accompanying drawings, in which:

FIG. 2(*b*) is the sectional view in elevation also taken along the line 2(*a*)—2(*a*) of FIG. 1 and showing the means for natural ventilation;

DESCRIPTION OF PREFERRED EMBODIMENTS OF THE INVENTION

Figure 2A:
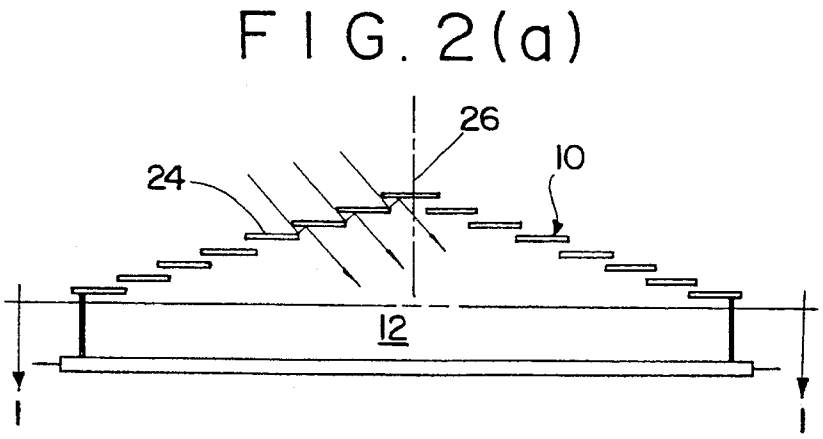
FIG. 2(*a*) is a sectional view in elevation taken along the line 2(*a*)—2(*a*) of FIG. 1 and showing the means for natural lighting.
Figure 2B:
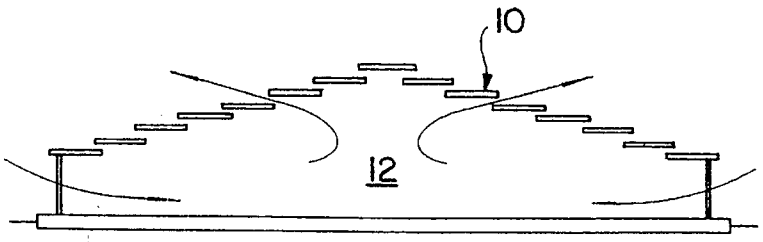
Figure 1:
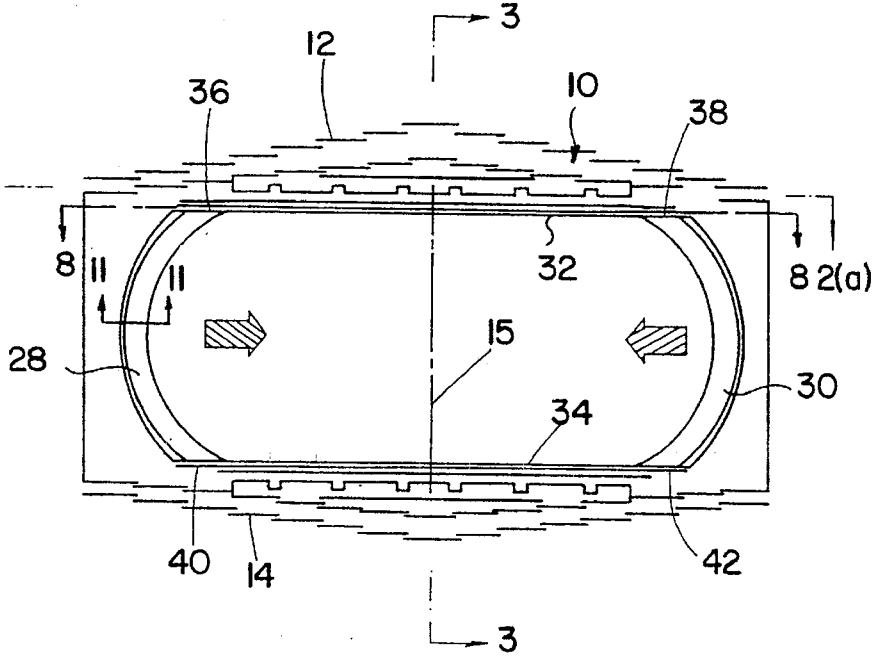
FIG. 1 is a plan view of a preferred embodiment of the inventive suspended roof arena taken along the line 1—1 of FIG. 2(*a*)

FIG. 1 is a top view of an arena 10 having a substantially rectangular floor plan. FIGS. 2(*a*) and 2(*b*) are schematic sectional views taken along a line 2(*a*)—2(*a*) of FIG. 1, which are sectional schematic elevations of the side 12 of the arena 10. The stands 16 and 18, along arena sides 12 and 14, respectively, decrease stepwise downwardly from the center of the arena 15 toward the arena end walls 20 and 22. As shown in FIG. 2(*a*), the stepped roof 24 also decreases stepwise downwardly from the roof center line 26 toward the arena end walls 20 and 22. With the stands and the roof decreasing step-wise toward the opposite end walls at approximately the same rate of decrease, the space between the stands and the roof remains approximately constant.

Figure 3:
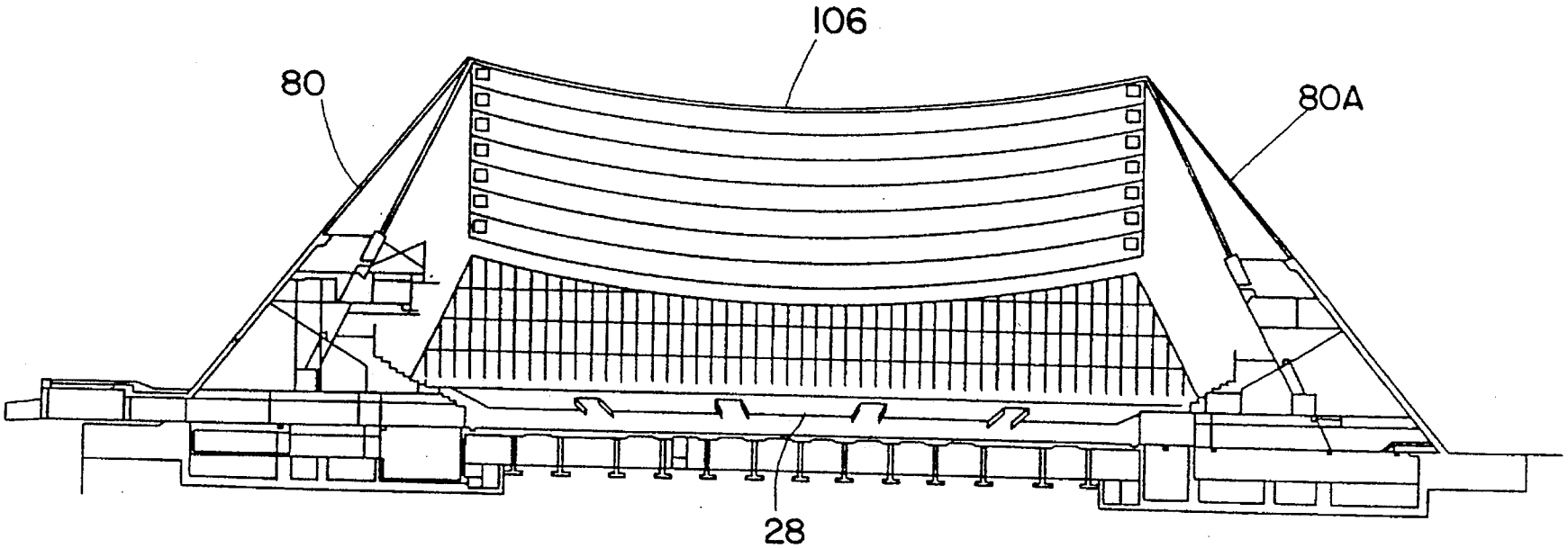
FIG. 3 is a sectional view in elevation taken along the line 3—3 of FIG. 1.
Figure 4:
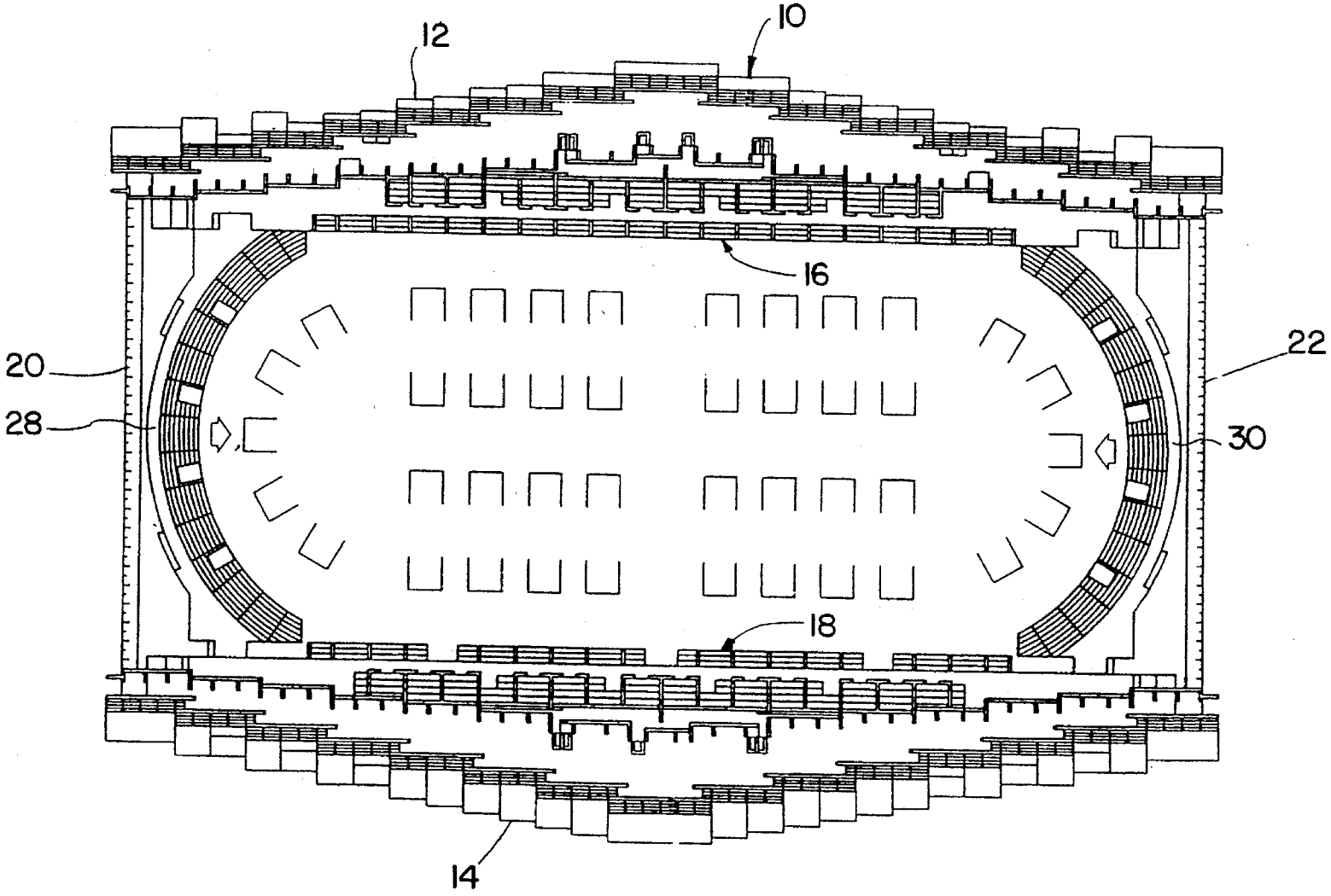
FIG. 4 is a plan view of the inventive arena, similar to FIG. 1, showing seating facilities for a single event utilizing the entire arena.

FIG. 3 is an elevational view in section of the arena 10 taken along the line 3—3 of FIG. 1. As best shown in FIG. 4, a pair of crescent-shaped movable stands 28 and 30 are adjacent arena end walls 20 and 22, respectively, and are equipped with rail-mounted wheels for moving stands toward and away from each other, as required.

As shown schematically in FIG. 1, guide rails 32 and 34 are spaced apart, parallel, and subtend the extremities 36 and 38 of the crescent-shaped stands 28 and 30.

Figure 8:
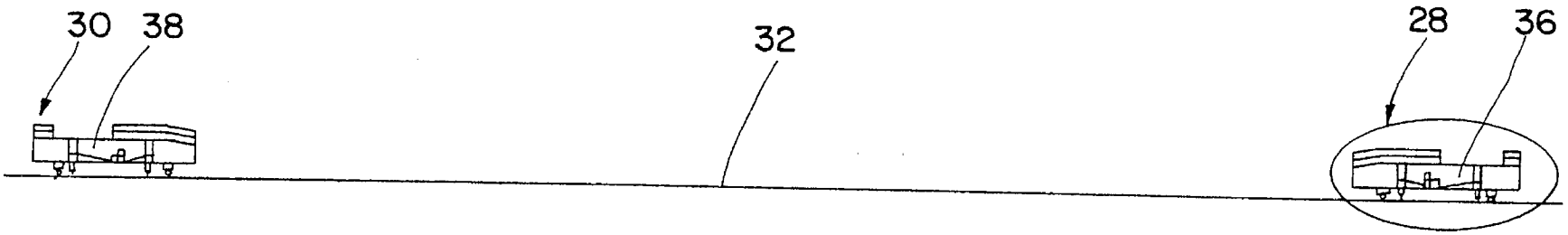
FIG. 8 is a fragmentary sectional view in elevation taken along the line 8—8 of FIG. 1 and schematically showing right and left movable stands with respective driving sections.

FIG. 8, taken along the line 8—8 of FIG. 1, schematically shows the extremities 36 and 38 of stands 28 and 30, respectively, mounted on guide rail 32. Extremities 40 and 42 of stands 28 and 30, mounted on guide rail 34, are the mirror image of extremities 36 and 38 mounted on guide rail 32.

Figure 9:
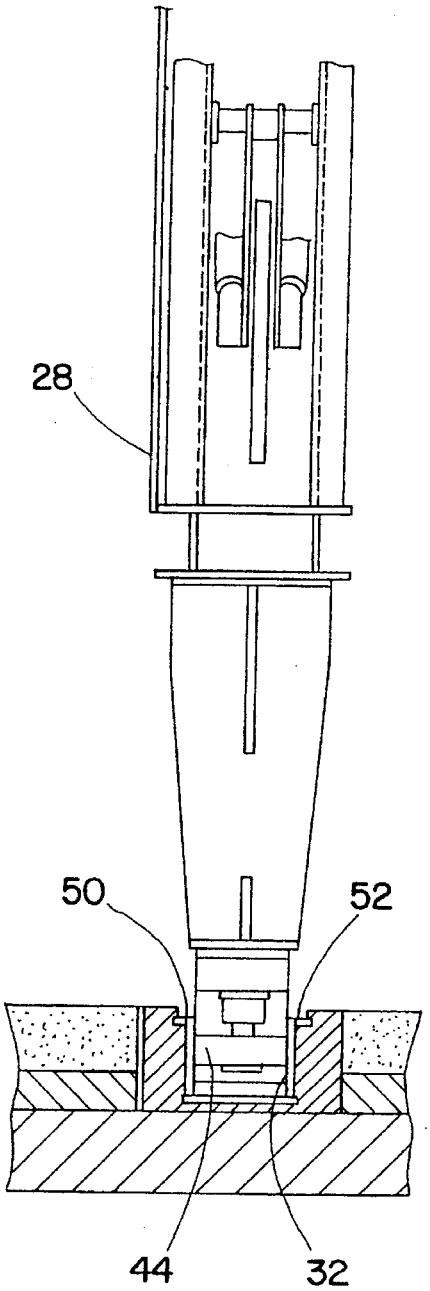
FIG. 9 is a fragmentary elevational view showing a guide roller and a guide rail mounted on a movable stand.

FIG. 9 is a fragmentary sectional view showing the guide roller 44 positioned within a U- or channel-shaped guide rail 32. Guide roller 44 is mounted on movable stand 28.

Figure 9A:
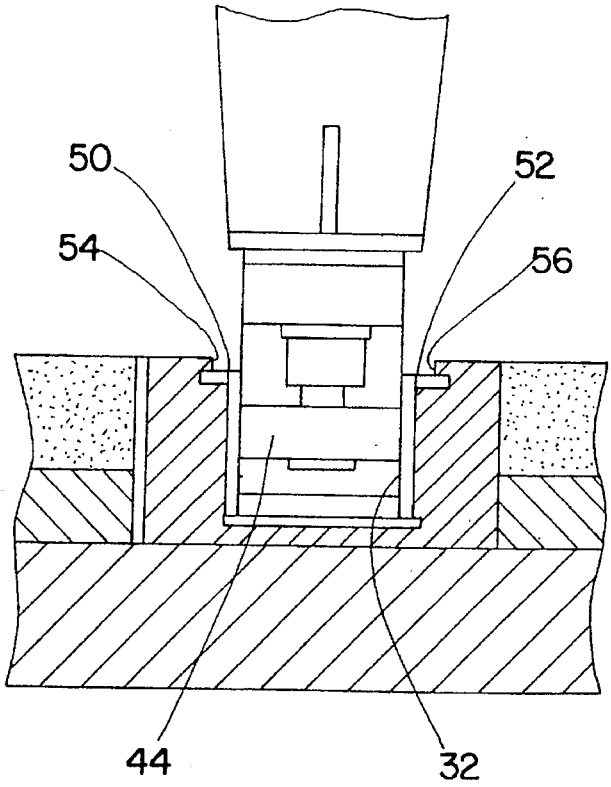
FIG. 9A is an enlarged fragmentary elevational view of the guide roller and guide rail of FIG. 9.

FIG. 9A is an enlarged fragmentary view of the lower end of FIG. 9.

Figure 10:
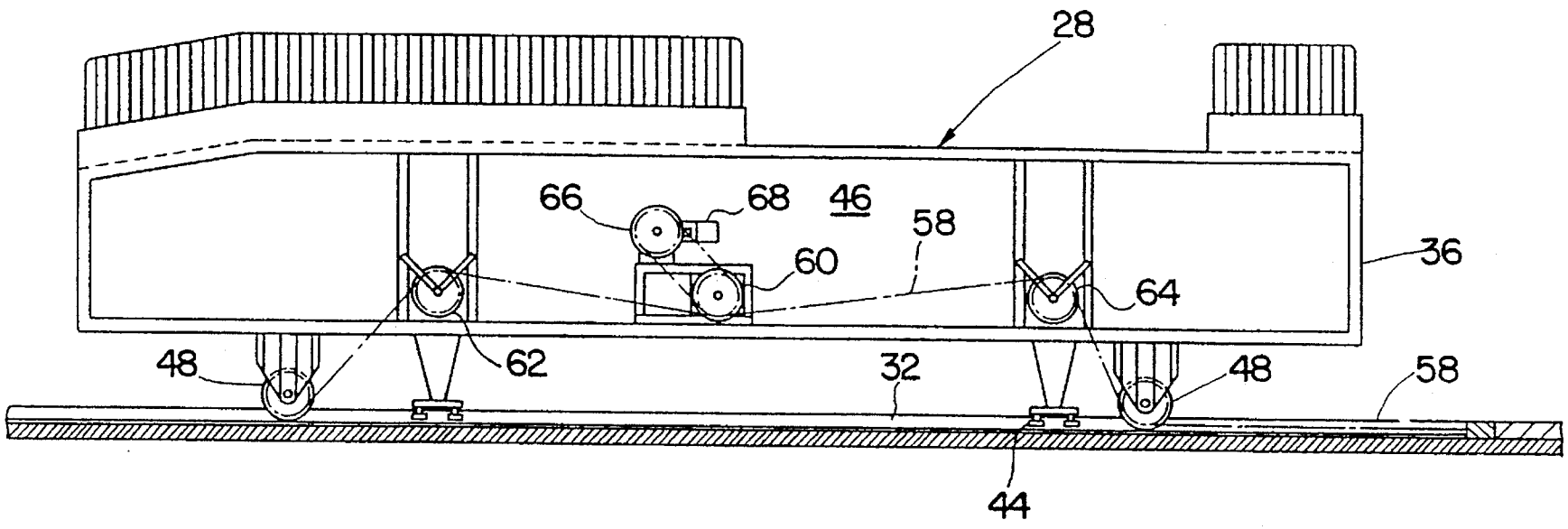
FIG. 10 is an enlarged detailed view of movable-stand driving sections of FIG. 8.
Figure 14:
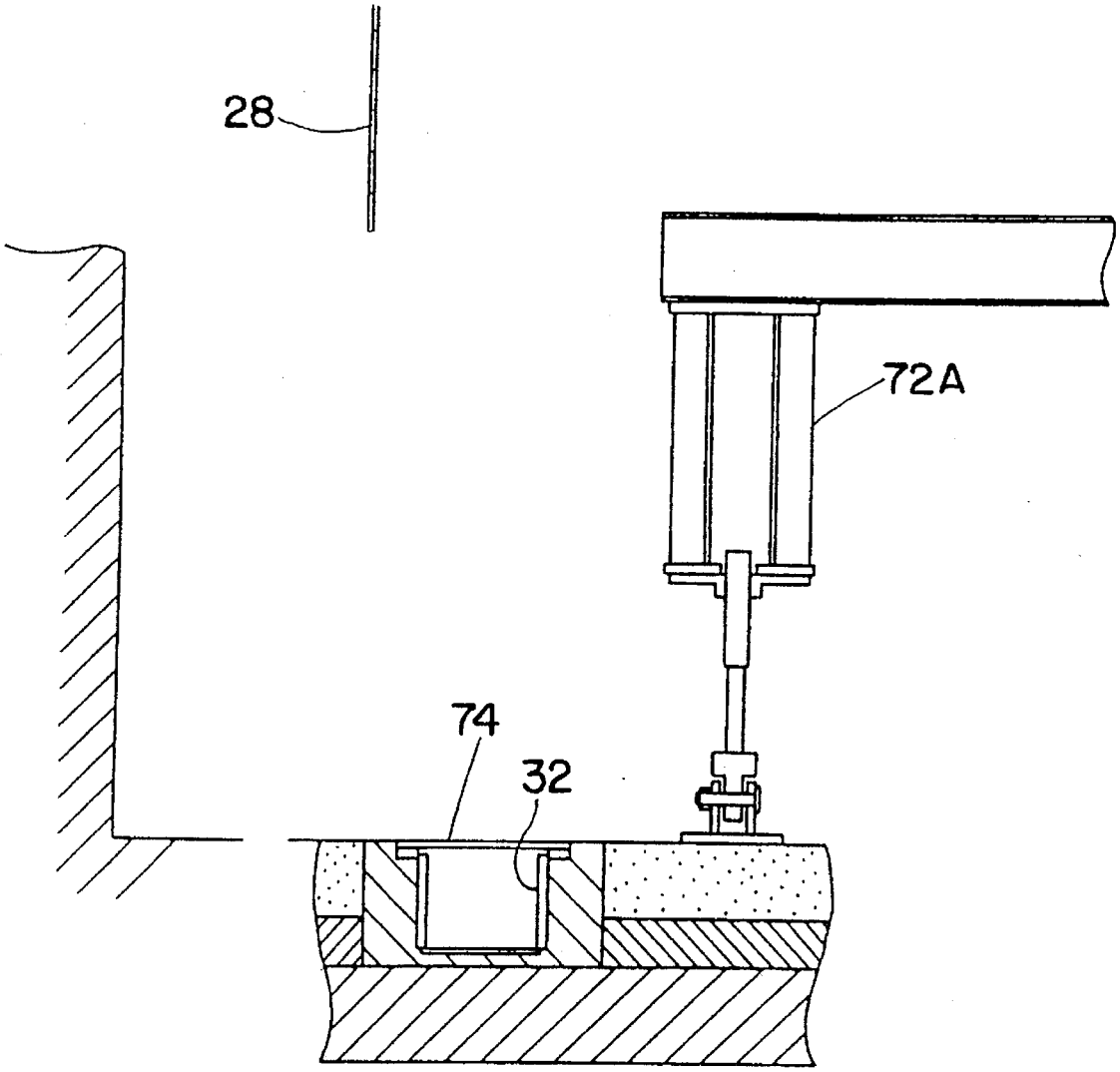
FIG. 14 is a fragmentary sectional view in elevation showing a guide rail and outrigger used in a preferred embodiment of the invention.

FIG. 10 shows a movable stand driving section 46 of stand 28 mounted on wheels 48 which are adapted to roll on the top surfaces 50 and 52 of guide rail 32 shown in FIG. 9A. Flanges 54 and 56 provide a recess for a guide rail cover 74 when the guide rail is not in use, FIG. 14. A wire rope 58 is stretched in the guide rail 32 and wound on a driving sheave 60 set between tension sheaves 62 and 64. The driving sheave 60 is connected to drive pulley 66 of drive motor 68. When the drive motor 68 is operated, the rope 58 moves the movable stand 28, which entirely encloses driving section 46, along guide rail 32. The wire traction system driving section is set at opposite ends of the four corners of the crescent-shaped movable stands 28 and 30.

Figure 11:
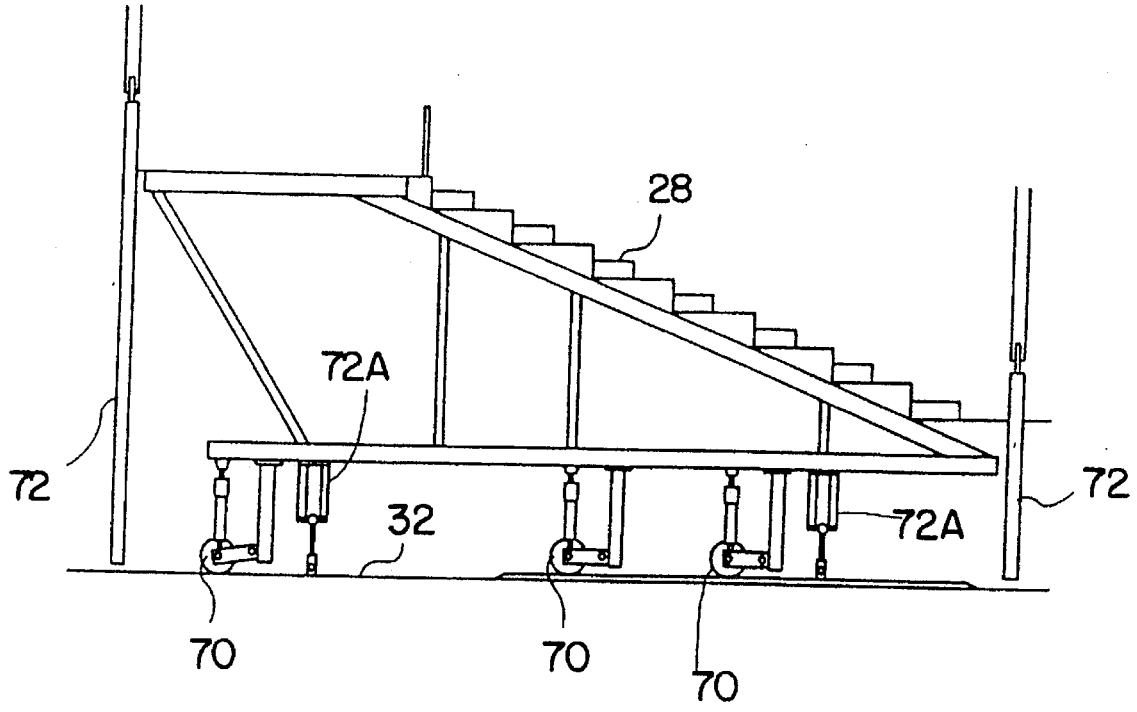
FIG. 11 is a sectional elevational view taken along the line 11—11 of FIG. 1 showing another preferred embodiment of a movable stand supported by a driving tire and an outrigger.

FIG. 11 is a sectional elevational view of stand 28 taken along line 11—11 of FIG. 1, showing that the movable stand 28 is supported by a driving tire 70 and outriggers 72 and retractable legs 72A.

Figure 12:
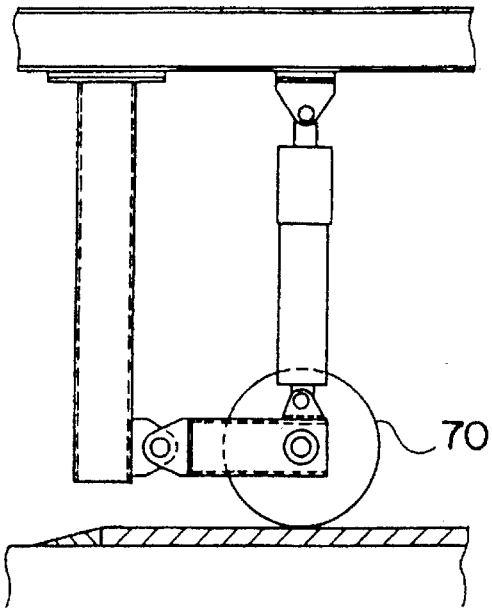
FIG. 12 is a fragmentary side elevational view of a driving tire used in a preferred embodiment of the invention.
Figure 13:
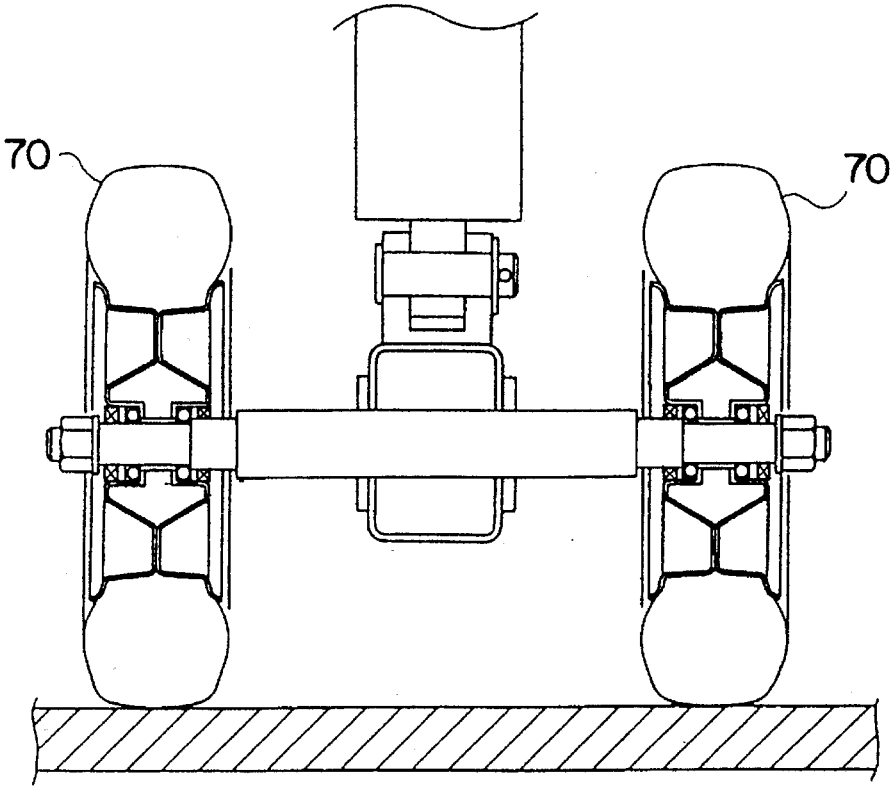
FIG. 13 is a fragmentary front elevational view in section of a driving tire used in a preferred embodiment of the invention.

FIG. 12 is an enlarged side elevational view of the driving tire 70 shown in FIG. 11, and FIG. 13 is a fragmentary front sectional view of the driving tire 70 of FIGS. 11 and 12.

The procedure for operating the movable stand 28 will be described below. First, obstacles are removed from the traveling route of the movable stand 28 and a pit cover 74 (FIG. 14) is removed from the guide rail 32. The outriggers 72 and retractable legs 72A are released. In the case of manual operation, an operator turns on the switch of a remote controller to start drive motor 68 to move the movable stand 28 to a predetermined position on the guide rail 32. The operator then replaces the pit cover 74 on the guide rail 32 and sets the outriggers 72 and retractable legs 72A to complete the operation.

Figure 5:
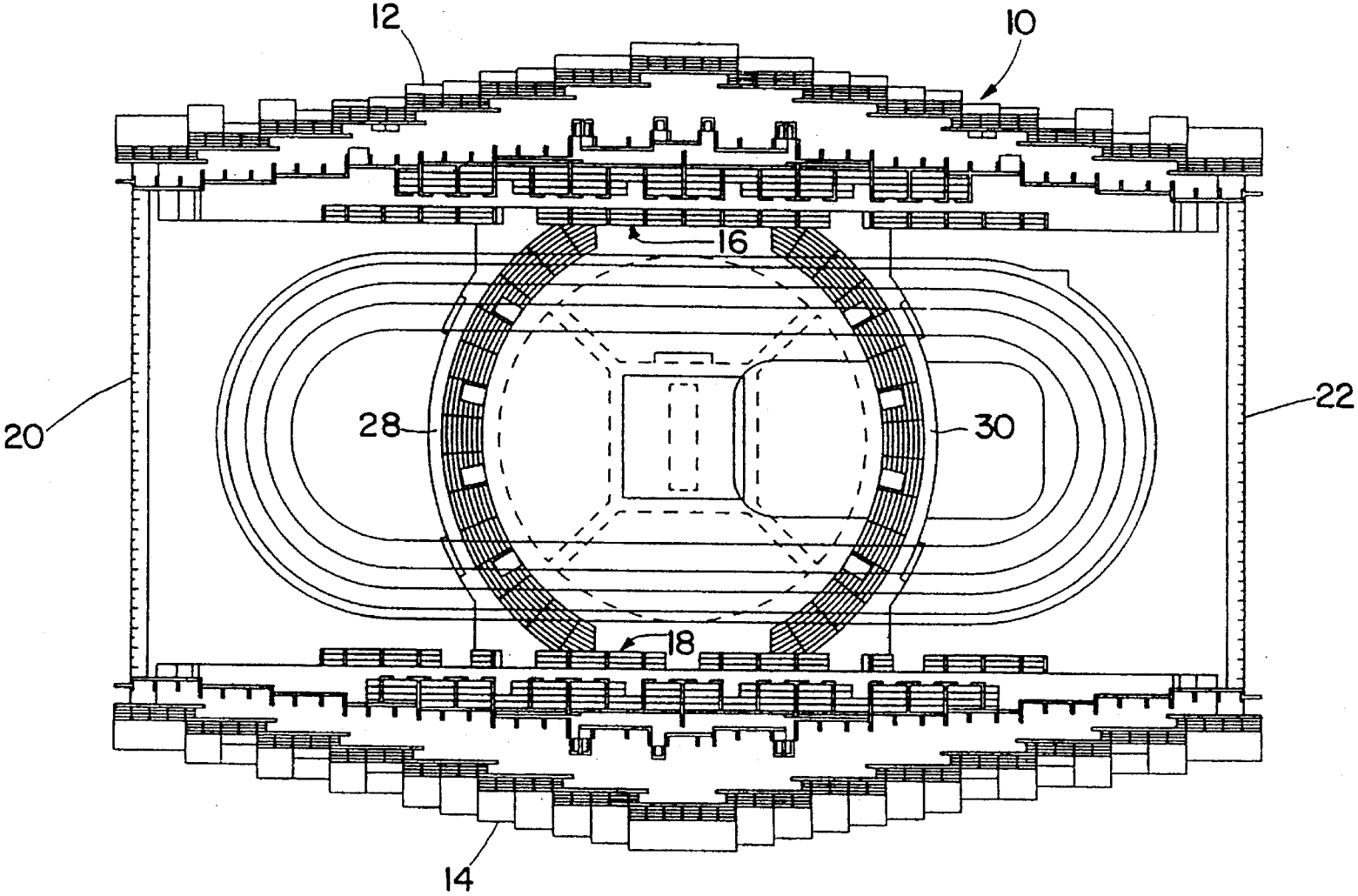
FIG. 5 is a plan view of the inventive arena, similar to FIG. 4, showing seating facilities for an event in the center of the arena.
Figure 6:
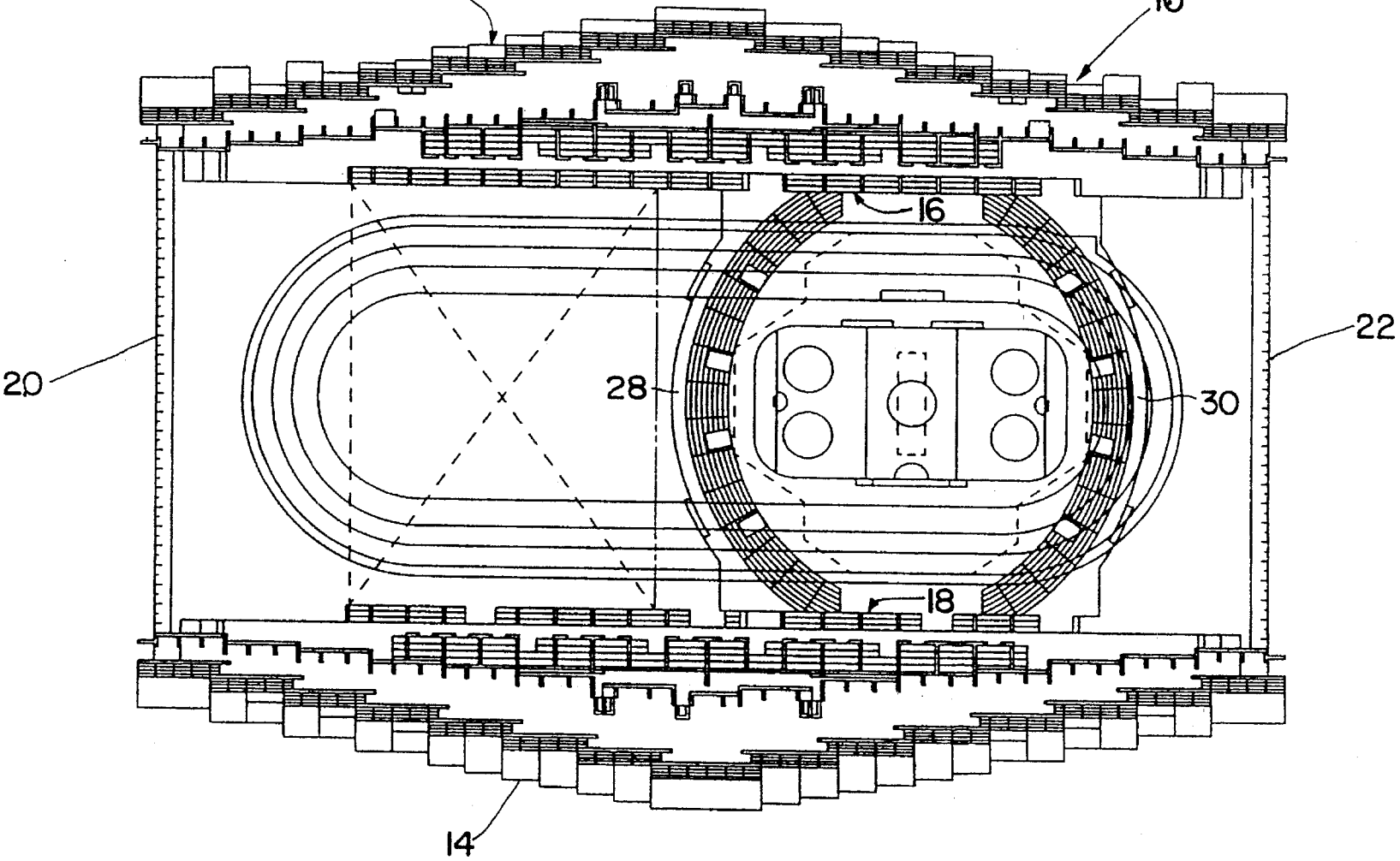
FIG. 6 is a plan view of the inventive arena, similar to FIG. 5, showing seating facilities for an event at one end of the arena.
Figure 7:
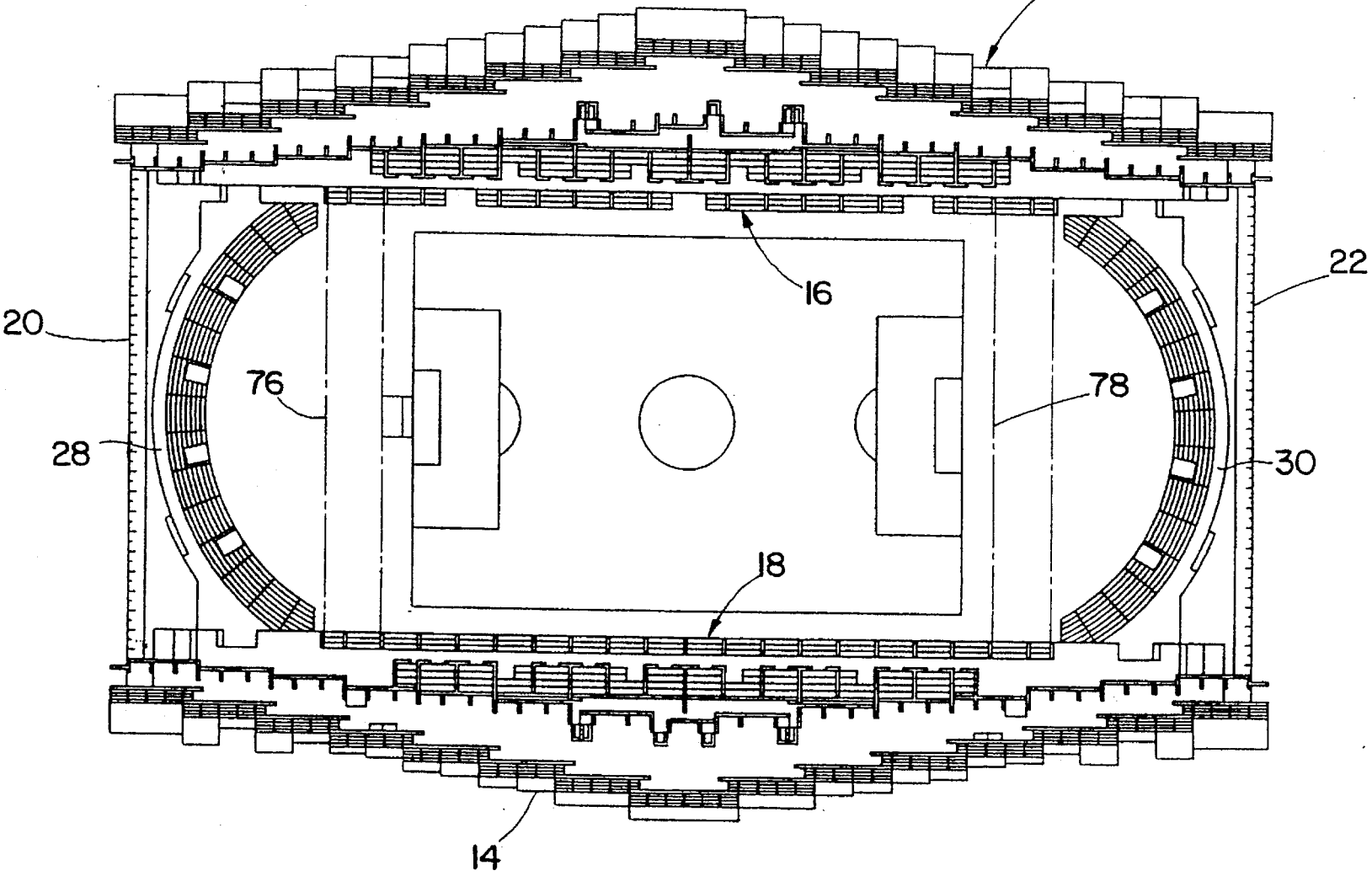
FIG. 7 is a plan view of the inventive arena, similar to FIG. 4, showing means to partition the arena in order to cater to a plurality of events.

In this manner, it is possible to cater to not only a large-space event using the whole space of the arena as shown in FIG. 4, but also a high-ceiling, small scale event, by moving the movable stands 28 and 30 to the central portion of the arena as shown in FIG. 5, or a low-ceiling, small-scale event, effected by moving the movable stands 28 and 30 to one end of the arena, as shown in FIG. 6. Moreover, it is possible to hold various types of events at the same time by dividing the large space into several small spaces with partitions 76 and 78, and using the equipment for each small space, instead of the large-space equipment. That is, it is always possible to secure a realistic easy-to-see venue by moving stand seats to the most desirable place that corresponds to the type and scale of the event, and to do so quickly.

An embodiment of a suspended-roof arena will be described below by referring to the accompanying drawings.

Figure 15:
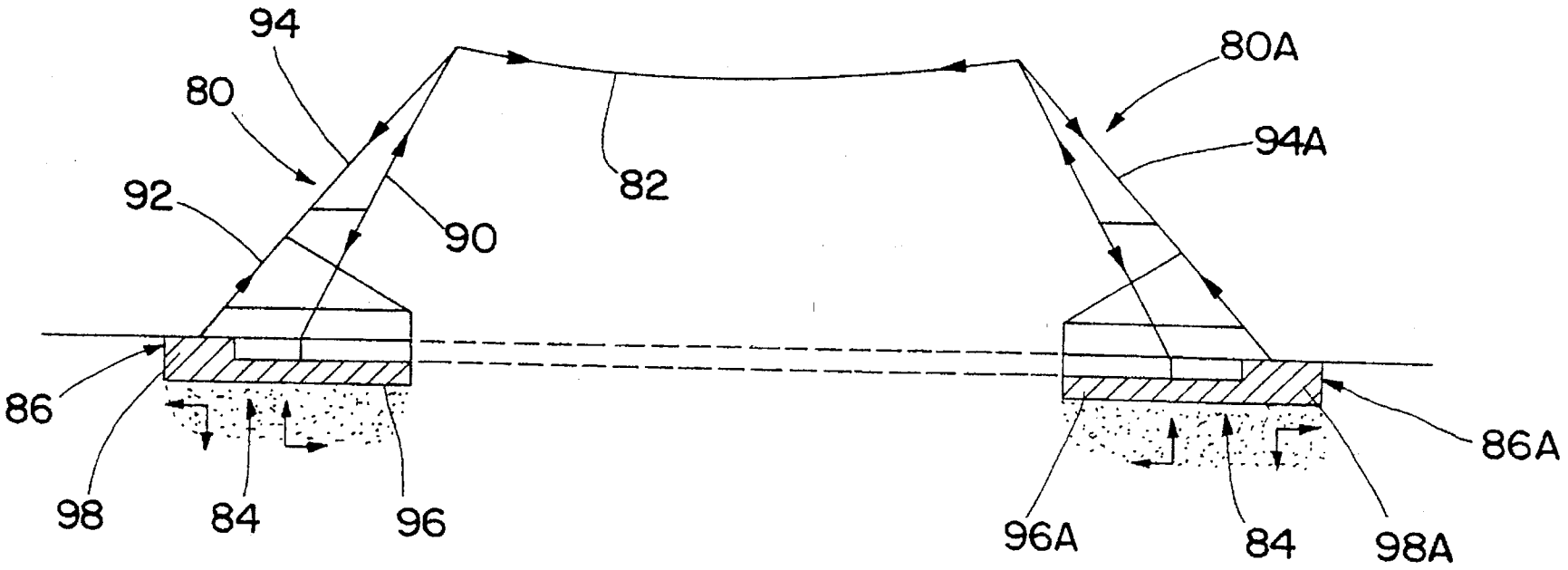
FIG. 15 is a schematic elevational view showing the configuration of a suspended roof arena and a vector analysis of the roof load transmitted to the foundation.
Figure 16:
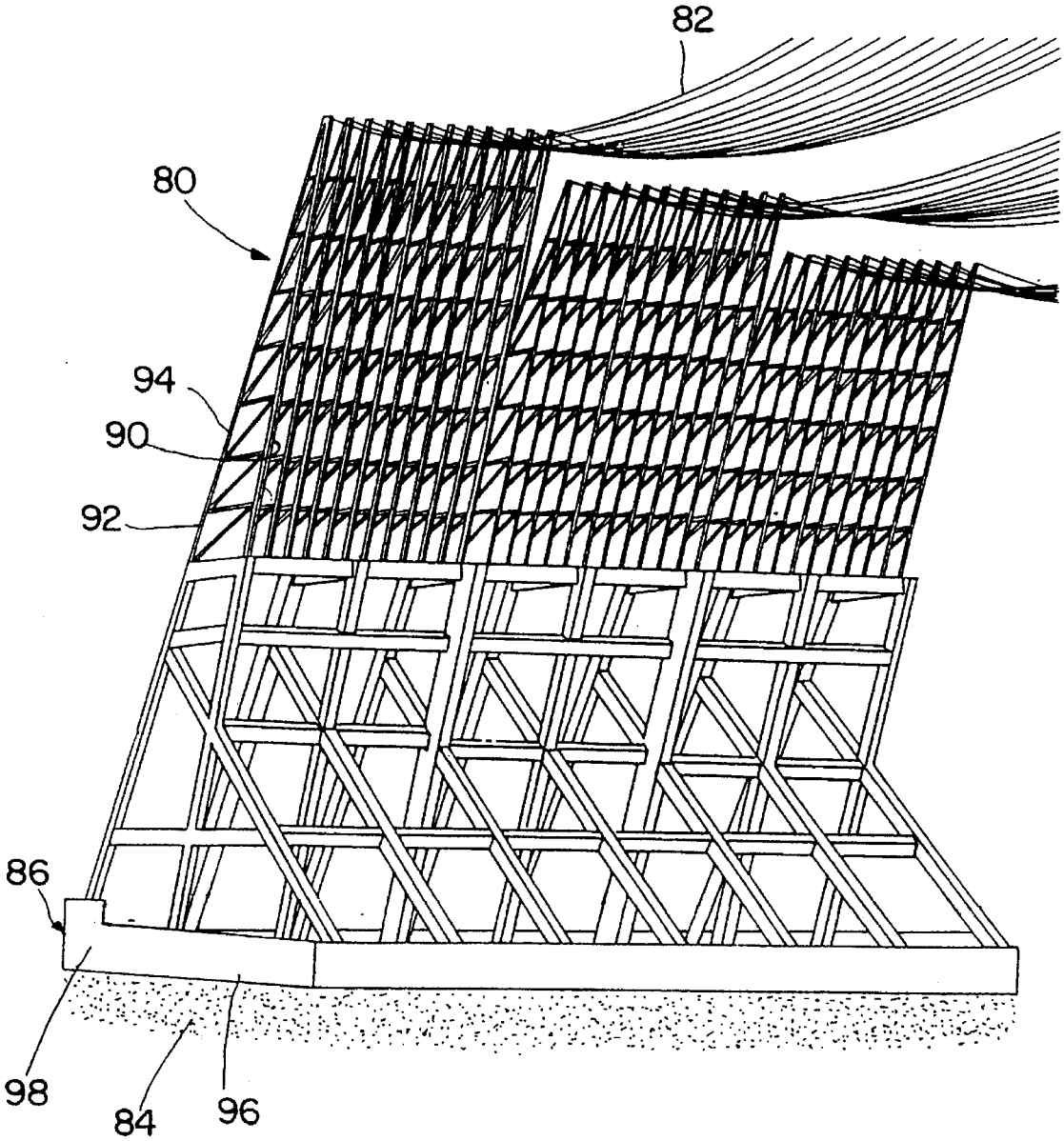
FIG. 16 is a perspective view showing a preferred embodiment of the inventive support pylons of the arena-supported roof.

FIG. 15 is a schematic elevation showing the outline of the suspended-roof arena and the flow of load. FIG. 16 is a perspective view of the framework of the suspended-roof arena 10. The suspended-roof arena of the present invention, as shown in FIGS. 15 and 16, comprises structural pylons 80 and 80A arranged in opposed parallel rows, suspending members 82 suspended between the opposed pylons 80 and 80A, and a foundation 84 upon which the bases 86 and 86A of pylons 80 and 80A, respectively, bottom. Pylons 80 and 80A and bases 86 and 86A bear the tension and vertical load of each suspending member 82.

The column 80, as shown in FIG. 15, bears the compressive force due to the vertical load of the suspending members 15 on its inboard side 90 and bears the load due to the tension of the suspending members 82 on its outboard side 92 to transmit the compressive force and the tensile forces to the base 86. Like forces are experienced in pylon 80A. In the schematic representation of FIG. 15, the upper structure 94 of the pylon 80 is preferably constituted with a steel frame construction. However, the structure of pylon 80 is not restricted to specific materials.

The base 86 is comprised of a mat slab 96 to which the inboard side 90 of pylon 80 is secured to transmit compressive forces from suspending members 82 to the foundation 84. Anchor 98 is connected to the outboard side 92 of pylon 80 and resists the tensile forces transmitted to pylon 80 outboard side 92 by the suspending members 82.

FIG. 16 is a perspective view of the pylon 80, suspending member 82, and base 86, shown schematically in FIG. 15.

Figure 17:
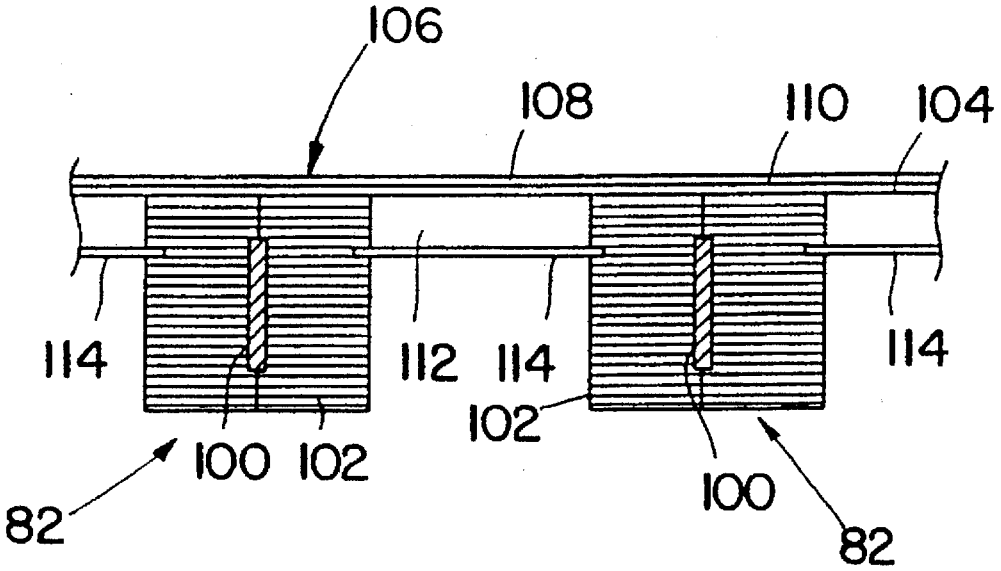
FIG. 17 is a cross-sectional view of a suspending member.

The suspending member 82, as shown in cross section in FIG. 17, is comprised of an elongated steel plate 100 and laminated wood 102 which encases the steel plate 100. The suspending member 82 has flexural rigidity due to the tension borne by the steel plate 100 and the bending moment borne by the laminated wood 102. Thus, the suspending member 82 has an independent shape-keeping capacity. The laminated wood 102 bears a local bending moment due to snow and wind load, and protects the steel plate 100 from rusting. The combination of steel plates 100 and laminated wood decreases the total weight of the roof. Because the suspending member 82 keeps its shape with no tension, the catenary of the suspending member 82 directly forms the shape of the roof as shown in FIG. 15, and the shape of the roof in the ridge direction is changed by the fact that the pylons 80 in opposed rows of pylons consecutively diminish.

Structural plywood 104 interconnects adjacent parallel laminated wood members to provide a base for the roof 106. A roofing material 108 is laid on and secured to the structural plywood 104 over a waterproof material 110. An insulation air space 112 is sealed by heat insulating material 114.

Figure 20:
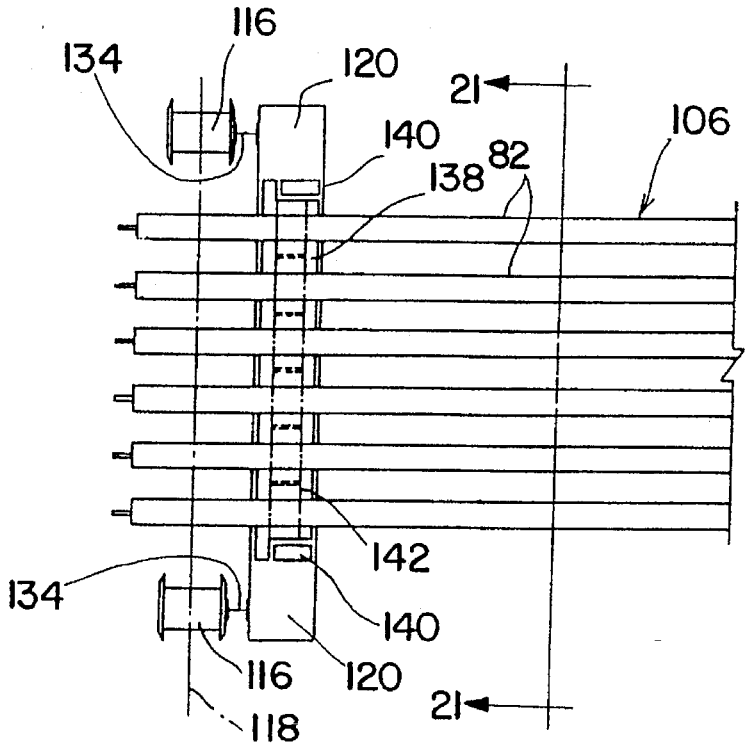
FIG. 20 is a plan view of suspending members in place prior to erection.
Figure 21:
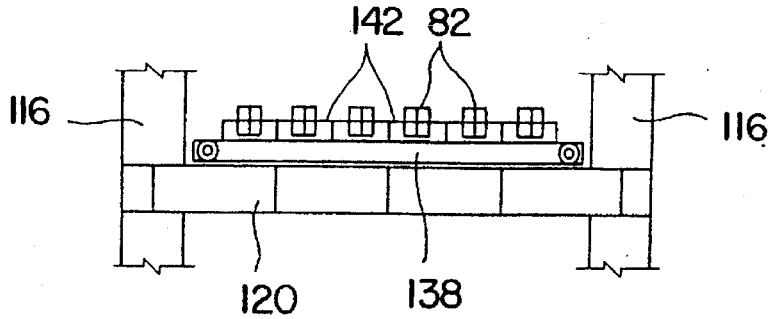
FIG. 21 is a sectional view taken along the line 21—21 of FIG. 20.

In order to construct a suspended roof section 106, as many suspending members 82 as are required to support a roof section 106 suspended between a pair of opposed pylons 80 and 80A are arrayed at ground level in parallel, spaced-apart fashion, as shown in FIGS. 20 and 21.

Figure 18:
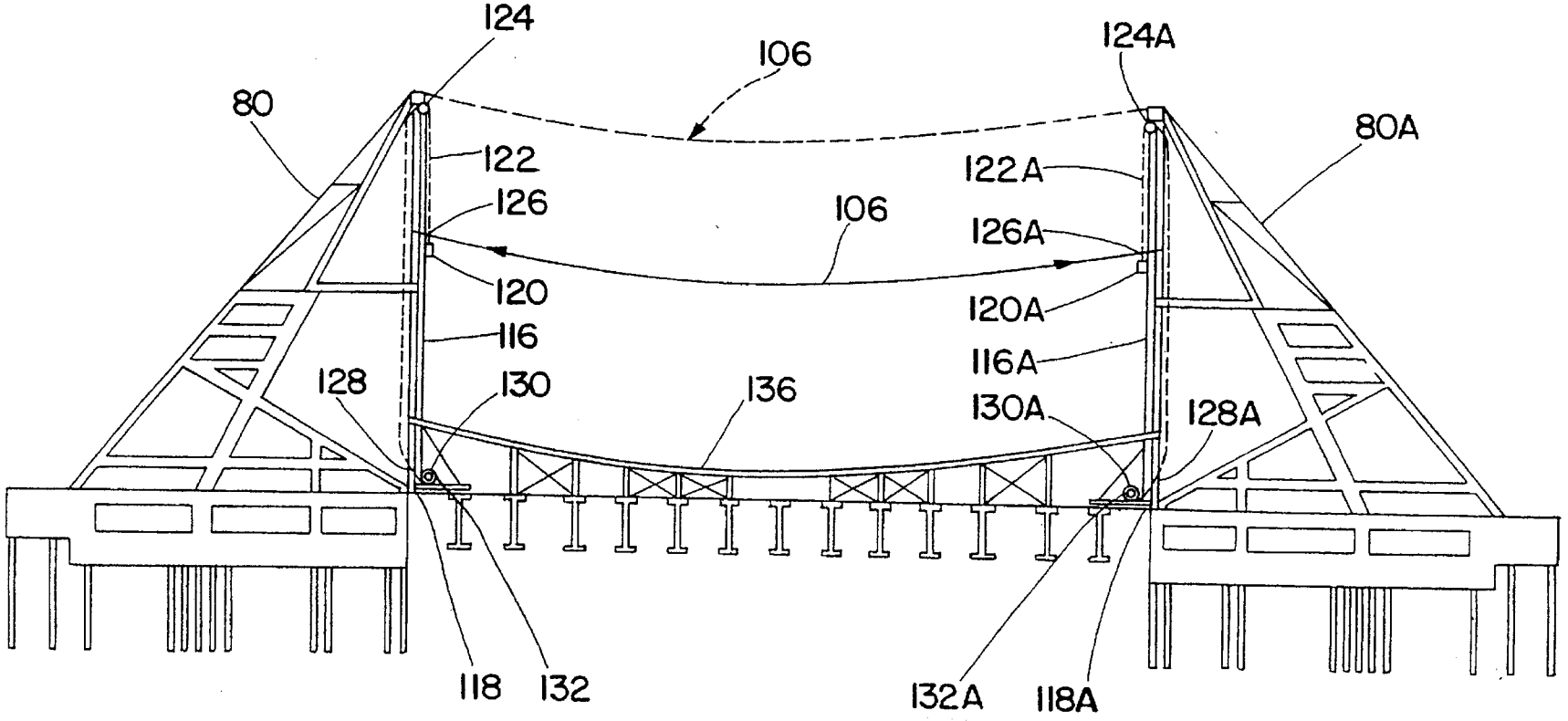
FIG. 18 is a vertical elevational view showing suspended roof erection apparatus used in practicing a preferred embodiment of the invention.
Figure 19:
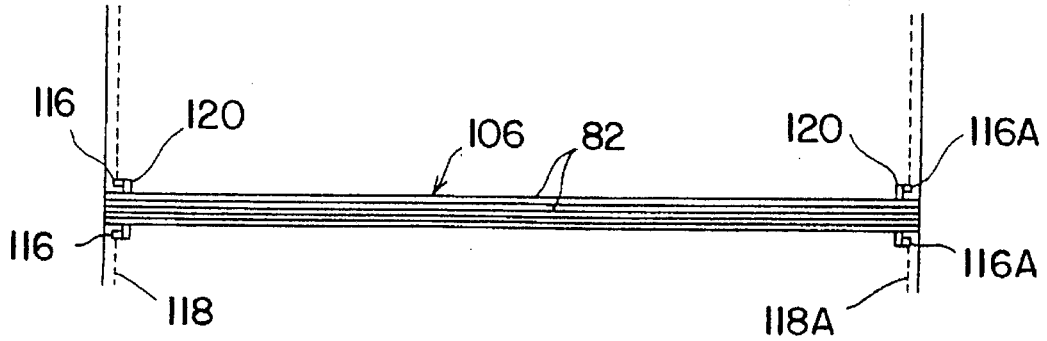
FIG. 19 is a detailed view showing a suspending member secured between a pair of temporary erection members.

As shown in FIGS. 18 and 19, temporary opposed columns 116 and 116A are erected at intervals on the inside of the pylons 80 so as to be movable parallel to the aligned pylons shown in FIG. 16. Temporary columns 116 an 116A are moved along rails 118 and 118A laid in the direction in which the suspending members 82 are arrayed in parallel order.

A lift 120, column 116, is vertically movable up and down on temporary column 116 and a wire rope 122 is threaded through a pulley 124 connected to the top of each temporary column 116, wherein one end 126 is connected to the lift 120 and the other end 128 is connected to a winch 130 secured to a supporting base plate 132. The lift 120 is secured to and vertically moves along rails 134 fastened to each temporary column 116.

As shown in FIGS. 20 and 21, roof sections 106 are assembled at ground level between pairs of opposed pylons 80 and 80A by sequentially building each combination of steel plate 100 and laminated wood 102 into a suspending member 106 on construction fixture 136. The suspending members 82 are then formed into a roof section by sequentially lifting and spacing each suspending member 82 onto a conveyor belt 138 by means of jacks 140 and 140A positioned at opposite ends of each section member to be lifted into place on the conveyor belt 138. The parallel, spaced apart, suspending members 82 are then interconnected with suitable hardware 142 to form a roof section unit 106, FIG. 17.

Figure 22:
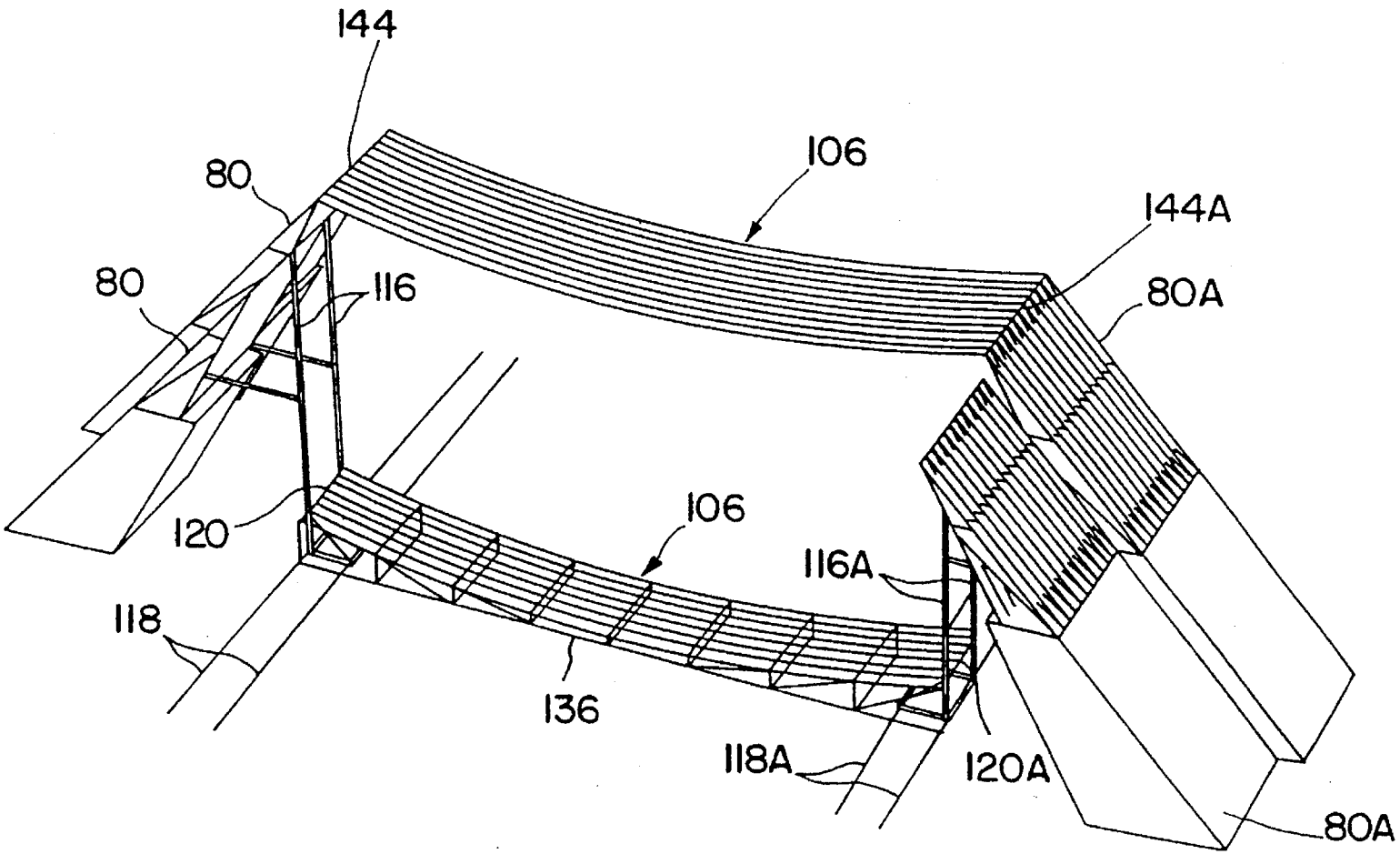
FIG. 22 is a perspective view showing suspending members secured between a pair of opposed structural pylons, in accordance with a preferred embodiment of the invention.
Figure 23:
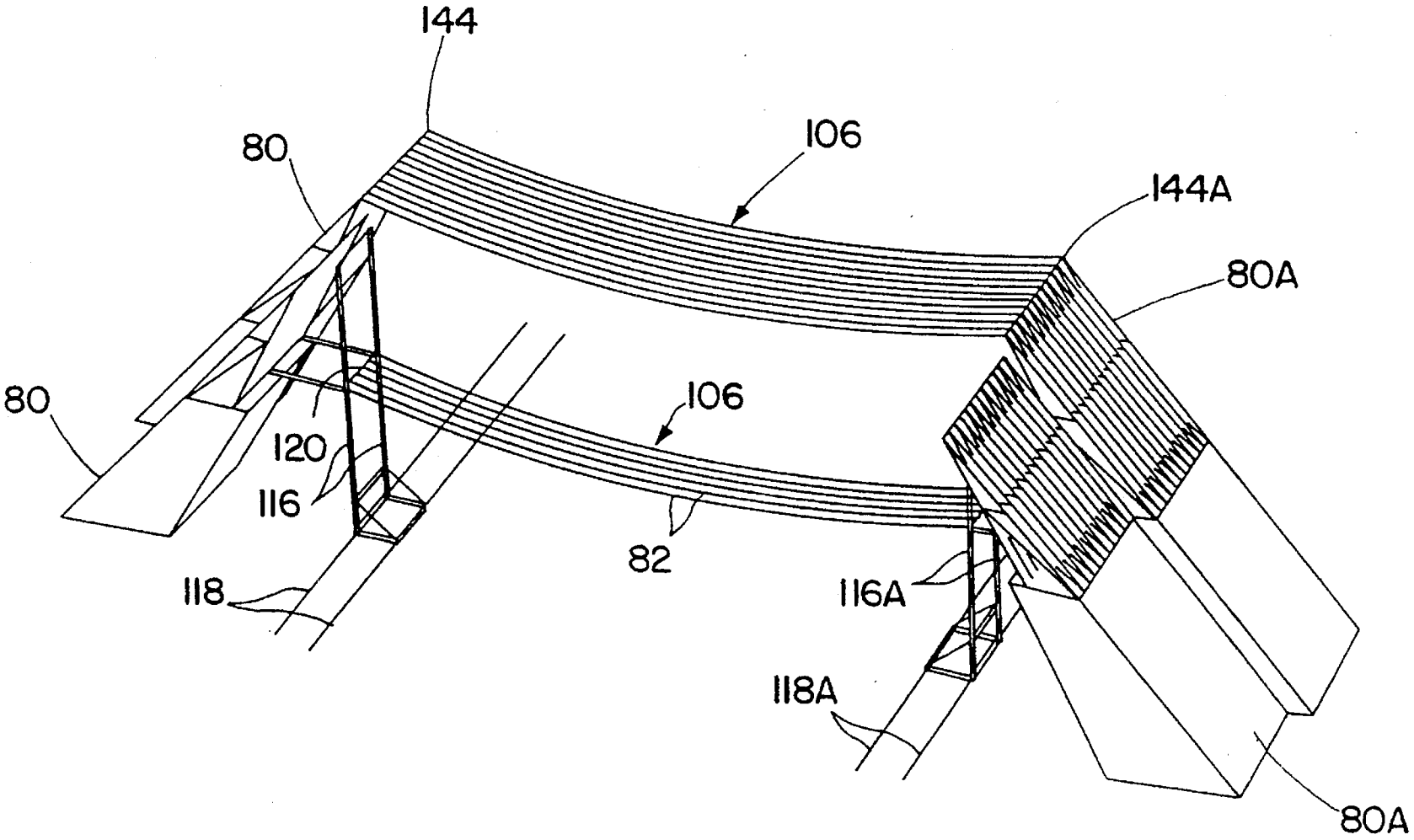
FIG. 23 is a perspective view similar to FIG. 22, showing suspending members secured in place between a pair of opposed structural pylons and other suspending members in the process of being lifted into place between a second pair of opposed structural pylons, in accordance with a preferred embodiment of the invention.
Figure 24:
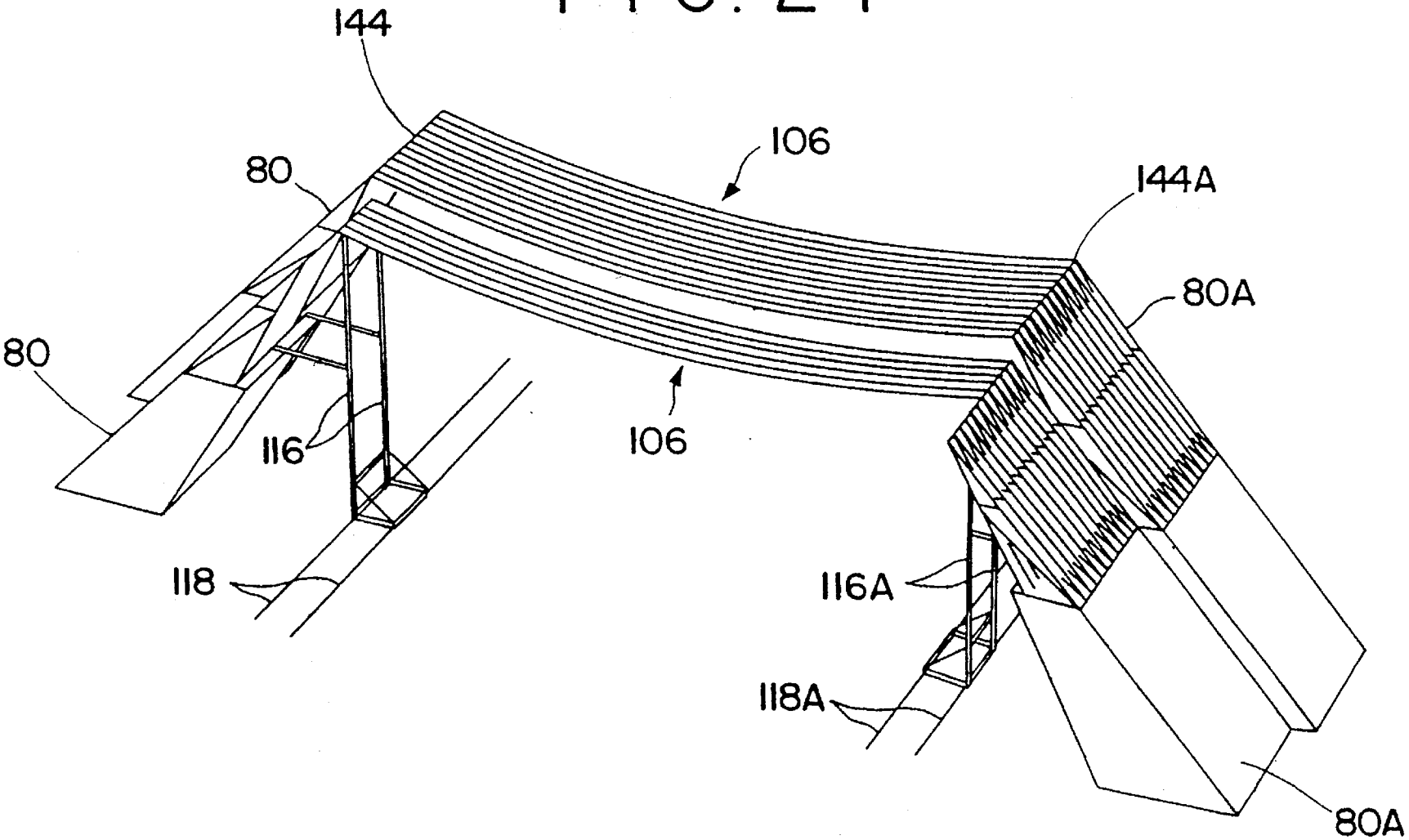
FIG. 24 is a perspective view similar to FIG. 23, showing other suspending members of FIG. 22 secured in place between the second pair of opposed structural pylons of FIG. 23.

Referring to FIG. 22, after a roof section 106 is assembled in place between pylons 80 and 80A, the roof section 106 is raised by lift 120, powered by winch 132, FIG. 18. As shown in FIG. 23, roof section 106 is in the process of being raised, and, as shown in FIG. 24, the roof section has been fully raised and secured to the top edges 144 and 144A of pylons 80 and 80A.

Thereafter, the lift 120 is lowered, and the temporary columns 116 and 116A are moved to the next pair of pylons. The process is then repeated until all roof sections are in place and secured between their respective opposed pairs of pylons.

The present invention makes it possible to improve the cost performance of illumination, sound, and air conditioning, both in the initial and the running costs, by changing the space volume. The arena can be set so as to fully use the entire space, or to correspond to a high-ceiling, small-scale event by moving the movable stand to the central portion, or a low-ceiling, small-scale event by moving the movable stand to one side of the arena.

It will occur to those skilled in the art, upon reading the foregoing description of the preferred embodiments of the invention, taken in conjunction with a study of the drawings, that certain modifications may be made to the invention without departing from the intent or scope of the invention. It is intended, therefore, that the invention be construed and limited only by the appended claims.

What is claimed is:

1. A method for constructing a permanent suspended roof of a multipurpose suspended-roof arena capable of changing a space volume, said arena extending upwardly from ground level, including the steps of constructing part of a suspended roof constituted by aligning substantially rigid suspending members, each having opposite ends and each including a steel material which bears tension, and laminated lumber which surrounds the steel material and bears bending movement, in a row in one direction as a unit at ground level, and thereafter lifting and setting said unit between previously constructed spaced apart opposed permanent columns facing each other, said permanent columns having inside faces and upper ends, comprising the steps of:

(a) erecting spaced apart opposed temporary columns at said opposite ends of said suspending members, and movable in the direction in which said suspending members are aligned in a row, between said inside faces of said opposed permanent columns, said temporary columns having upper ends and lower ends and pulley means secured to said upper ends;

(b) setting a vertically movable lift between said temporary columns aligned in a row;

(c) securing a winch to each of said lower ends of said temporary columns;

(d) stretching a wire from said lift through each said pulley means at said upper end of each temporary column and then to said winch;

(e) thereafter constructing said unit on said lift longitudinally aligned between opposed temporary columns;

(f) operating said winch to raise said lift while adding tension to each suspending member of said unit;

(g) connecting said opposite ends of each suspending member to the said upper end of an adjacent permanent column;

(h) moving each temporary column by a certain distance; and (i) repeating the procedure from construction of the unit on said lift to moving of said temporary columns to set said suspending members between said opposed permanent columns.

2. A permanent, rigid, non-foldable, non-retractable suspended roof arena comprising: opposed substantially parallel sides; opposed substantially parallel opposite ends transverse to said sides to define a rectangular arena floor plan having a transverse centerline; opposed roof supporting pylons arrayed parallel to said sides; one-piece rigid, non-rotatable, roof-supporting structural members suspended between pairs of opposed pylons, each having an upper end and a lower end, said pairs of pylons in height being of stepped descending order from the transverse centerline of said arena toward said opposite ends; and a first pair of rigid opposed spectator stands, each wheel-mounted for moving as an integral unit on parallel guide rails extending between said opposite ends.

3. The suspended roof arena of claim 2, wherein said roof supporting structural members each comprise an elongated one-piece steel plate extending between and secured to said upper ends of a pair of stationary opposed roof-supporting pylons, said elongated one-piece steel plate being reinforced and encased in laminated wood.

4. The suspended roof arena of claim 2, including a second pair of opposed spectator stands parallel and adjacent to said arena sides, said stands in height being of stepped descending order from said transverse centerline of said arena toward opposite ends.

5. The suspended roof arena of claim 2, including partition means extending transversely from one of said sides to the other of said sides, whereby said arena is enabled to simultaneously hold several events by selectively shifting said wheel-mounted spectator stands.

6. The suspended roof arena of claim 2, wherein each of said first pair of spectator stands are motorized for movement as a single unit on said guide rails selectively toward or away from said opposite ends of said arena.

7. The suspended roof arena of claim 6, wherein said guide rails are U-shaped to define a cable housing slot, a stationary drive cable laid in said cable housing slot of said U-shaped guide rails, and motor and cable pulley means mounted on said stands and arranged to frictionally engage said stationary drive cable to pull said stands along said stationary drive cable.

8. The suspended roof arena of claim 7, wherein said cable pulley means comprises: first and second stand guide rail wheels; first and second drive cable tensioning pulleys; and first and second motor-driven pulleys; said drive cable being threaded beneath said first stand guide rail wheel over said first drive cable tensioning pulley, around said first motor-driven pulley, around said second motor-driven pulley, over said second tensioning pulley and beneath said second stand guide wheel, whereby rotation of said motor-driven pulleys drives said tensioning pulleys and said guide rail wheels along said drive cable.

9. The suspended roof arena of claim 2, wherein said pylons are triangular with said lower end of each pylon being anchored in a concrete slab and said upper end of each pylon being secured to one end of one of said roof supporting structural members; and wherein each of said opposed roof-supporting pylons comprises a constant front compression member and a constant rear tension member, the respective compression and tension in said compression member and said tension member being irreversible.

10. The method of constructing a suspended roof arena having a floor, a predetermined floor width, floor side portions and opposite floor end portions, and a transverse centerline, comprising the steps of:

(a) erecting pairs of opposed roof-supporting pylons having upper and lower ends, and spacing apart said opposed roof-supporting pylons in excess of the width of said arena;

(b) placing and aligning a steel plate of sufficient length to extend between a pair of opposed pylons;

(c) forming a roof-supporting structural member having opposite end portions by encasing said steel plate with laminated wood;

(d) erecting a vertical hoisting tower having an upper end and a lower end adjacent each said opposite end portion of said roof supporting structural member;

(e) securing to each said vertical tower a wire rope winch at said lower end, said wire rope having a free running end and an end secured to said winch, said free running end being threaded through a wire rope pulley secured to said vertical tower upper end;

(f) securing each said wire rope free running end to one of said opposed end portions of said roof-supporting structural member;

(g) simultaneously winching each said wire rope secured to said opposed end portions of said roof-supporting structural member until said roof-supporting structural member is raised to said upper ends of said opposed roof-supporting pylons;

(h) securing said opposed ends of each roof-supporting structural member to said upper ends of said opposed roof-supporting pylons;

(i) repeating steps (a) through (h) with adjacent pairs of opposed pylons until sufficient roof-supporting structural members are secured to said upper ends of said roof-supporting pylons to support an entire roof; and (j) covering said roof-supporting structural members with roofing material.

11. The method of constructing a suspended roof arena of claim 10, including the additional step of forming said roof-supporting structural member on a catenary-configured fixture.

12. The method of constructing a suspended roof arena of claim 10, including the additional steps of:

(k) forming triangular pylons having bases and apexes;

(l) securing said bases to concrete slabs; and (m) securing said apexes to opposite ends of said roof-supporting structural members.

13. The method of constructing a suspended roof arena of claim 12, including the additional step of inclining said triangular pylons toward said arena, wherein said triangular pylons have an inner short leg and an outer long leg, and whereby said short leg receives the compression forces from said suspended roof and said long leg receives tension forces from said suspended roof, whereby said short and long legs transmit said compression and tension forces, respectively, from said suspended roof to said concrete slabs.

14. The method of constructing a suspended roof arena of claim 10, including the additional step of constructing each suceeding pair of opposed pylons stepwise shorter than their adjacent preceding pair of opposed pylons, measured from said transverse centerline of said arena and progressing simultaneously toward each said opposite end portion of said arena.

15. The method of constructing a suspended roof arena of claim 10 including the additional step of constructing spectator stands in sections in said arena parallel to said side portions, each said section being stepwise lower than its adjacent preceding section measured from said transverse centerline of said arena and progressing simultaneously toward each said opposite end portion of said arena.

16. The method of constructing a suspended roof arena of claim 10, including the additional steps of:

(k) laying guide rails in said floor of said arena parallel to said side portions;

(1) constructing opposed spectator stands at opposite ends of said arena;

(m) mounting wheels on said spectator stands;

(n) placing said mounted wheels on said guide rails; and (o) motorizing said wheels so as to cause said spectator stands to move on said guide rails.

* * * * *